US006761209B2

(12) United States Patent
Fink

(10) Patent No.: US 6,761,209 B2
(45) Date of Patent: Jul. 13, 2004

(54) METHOD OF OPERATING A HOT-CHAMBER PRESSURE DIECASTING MACHINE AND A PRESSURE DIECASTING MACHINE

(75) Inventor: Ronald Fink, Winterbach (DE)

(73) Assignee: Oskar Frech GmbH & Co., Schorndorf (DE)

( * ) Notice: Subject to any disclaimer, the term of this patent is extended or adjusted under 35 U.S.C. 154(b) by 0 days.

(21) Appl. No.: 10/214,182

(22) Filed: Aug. 8, 2002

(65) Prior Publication Data

US 2003/0029596 A1 Feb. 13, 2003

(30) Foreign Application Priority Data

Aug. 9, 2001 (EP) ..... 01118778

(51) Int. Cl.[7] ..... B22D 17/02; B22D 17/32

(52) U.S. Cl. ..... 164/457; 164/113; 164/155.2; 164/316

(58) Field of Search ..... 164/457, 151.3, 164/155.2, 113, 316–318

(56) References Cited

U.S. PATENT DOCUMENTS 3,270,378 A 9/1966 Madwed
5,971,057 A * 10/1999 Yukisawa et al. ..... 164/113
6,062,294 A * 5/2000 Yukisawa et al. ..... 164/113

FOREIGN PATENT DOCUMENTS

DE 2922914 12/1980
WO 95/33588 12/1995

OTHER PUBLICATIONS

Search Report.

* cited by examiner

*Primary Examiner*—Kuang Y. Lin
(74) *Attorney, Agent, or Firm*—Crowell & Moring LLP

(57) ABSTRACT

A method is described of operating a hot-chamber pressure diecasting machine and a pressure diecasting machine suitable for the implementation of this method, by which a prefilling of the casting system can be carried out before the actual mold filling operation. During this prefilling operation, the air present in the casting system after each shot when the casting plunger is withdrawn, is pressed out during this prefilling operation through the mold which is still open during this time period. This amount of air therefore no longer has to escape during the subsequent mold filling operation. The mold filling operation and the pressing-in operation can therefore be implemented more effectively and within a shorter period of time.

13 Claims, 2 Drawing Sheets

METHOD OF OPERATING A HOT-CHAMBER PRESSURE DIECASTING MACHINE AND A PRESSURE DIECASTING MACHINE

BACKGROUND AND SUMMARY OF THE INVENTION

This application claims the priority of Application No. 01118778.8, filed Aug. 9, 2001 in Europe, the disclosure of which is expressly incorporated by reference herein.

The present invention relates to a method of operating a hot-chamber pressure diecasting machine in which liquid metal is delivered in shots by a plunger, which can be moved back and forth, from a casting vessel dipping into a metal bath, through the ascending duct of the casting vessel, to a mouthpiece body and a nozzle tip into a mold and is pressurized there.

The invention also relates to a hot-chamber pressure diecasting machine for implementing such a method.

Metal diecast parts are increasingly used in all technical fields where the highest possible product quality is demanded. It is known in this respect (German Patent Document DE-PS 29 22 914) to utilize path-dependent signals for controlling the pressing-in operation or signals which are dependent on the pressing-in pressure and from which conclusions can be drawn concerning the respective position of the casting plunger and thus concerning the filling ratio of the mold. From International Patent Document WO 95/33588, it is known to provide, in the end area of the mouth piece, thus just in front of the nozzle tip, a metal sensor projecting from above into the mouthpiece, in order to obtain precise actual values concerning the position of the metal front during the shot and to derive therefrom corresponding control signals for the filling of the mold and the course of the pressing-in pressure. Together with the use of highly dynamic continuous valves with very low switching times, this measure is used for obtaining better products while the casting is thin-walled.

However, care has to be taken in all cases that the air present in the mold before the shooting-in of the metal and the air situated in the ascending duct and in the mouthpiece body can escape as completely as possible in order to avoid as much as possible the formation of bubbles within the diecast part. It is known that all hot-chamber diecasting machines operate such that, after each shot, the casting plunger is moved back into its original position in which a connection opening is opened up between the metal bath tempered in the furnace and the casting cylinder in order to refill the casting cylinder first emptied during the casting operation. During this return movement of the casting plunger, a certain vacuum is generated in the ascending duct and in the mouthpiece body. Since, in addition, the mouthpiece body also slightly rises toward the nozzle tip and toward the mold, metal which still exists there after the diecasting operation flows back into the casting vessel to a level which is determined by the level of the metal bath. The ascending duct and the mouthpiece body are therefore filled with air before each shot and care must be taken that also this air, which is driven along in front of the metal front during the mold filling operation, can escape through the mold. This has the result that the mold filling operation cannot take place at a high velocity which is possible per se for the metal filling of the mold. In addition, the delivery operation of the molten metal and thus the forward movement of the casting plunger can start only when the mold, which is opened up first after the preceding shot for the removal of the workpiece, is closed again. As a result, the cycle period between each shot is extended, particularly by the casting plunger which is moving at a very low rate in the first filling phase. In addition, it is nevertheless not possible to cause all the air to escape through the venting ducts assigned to the mold, so that air voids may be formed in the cast part.

It is an object of the present invention to provide a remedy here and to suggest a method of operating a hot-chamber pressure diecasting machine and a correspondingly designed pressure diecasting machine by means of which the air can be removed from the mold and from the casting system in a relatively reliable manner.

For achieving this object, it is provided in the case of the method of the initially mentioned type according to the invention that, after each shot, while the mold is open, the casting plunger is moved from its withdrawn position, in which it opens up an inflow from the metal bath into the casting cylinder of the casting vessel, into an advanced position, in which the ascending duct and the mouthpiece body are filled with liquid metal, that the mold is then closed and only then will metal be pressed into the mold.

As a result of this measure, the time period, during which the mold is open anyhow for the removal of the workpiece, can be utilized for a segment of the delivery operation of the molten metal for the new shot. Simultaneously, it is provided that the air situated in the ascending duct and in the mouthpiece body is pressed out of the casting system, in which case it is not difficult for the air to escape because of the still open mold. After the implemented closing of the mold, the actual pressure diecasting operation can then be initiated during which only the air still present in the mold has to be pressed out of the mold through the corresponding venting ducts before the pressure onto the molten metal is increased and the pressing-in operation is completely implemented. At least the amount of air, which in the prior art has to be pressed out of the ascending duct and the mouthpiece body, that is, out of the casting system itself, during each shot, can escape in a simple manner, specifically during a time period which has to be provided anyhow for the removal of the cast part between each shot.

As a further development of the invention, the arrival of the liquid metal at the mouthpiece tip can be detected, the mold closing operation can be initiated and the casting plunger can be held until the mold is closed. As a result of this further development, in comparison to the prior art, because of the prefilling of the casting system, the actual mold filling and pressing-in operation can be carried out significantly faster and more accurately, so that it will be possible to manufacture with great efficiency high-quality products without any trapped air.

For the implementation of the new method, a hot-chamber pressure diecasting machine is suitable which is equipped with a duct ascending in the mouthpiece body from the ascending duct to the nozzle tip and with a metal sensor arranged in the area of the nozzle tip, in which case, however, the metal sensor is mounted differently than in the suggestion of International Patent Document WO 95/33588, namely on the underside of the mouthpiece body. Specifically, as a result of this further development, the metal sensor is flooded by the liquid metal which, in the prefilling phase, slowly fills up the casting system, and a sensitive control can take place. As known, mouthpiece bodies of available hot-chamber diecasting machines have a slope of approximately 5°, which can be utilized for causing the metal in this inclined mouthpiece body duct to slowly rise, as a result of the forward movement of the casting piston, until reaching the metal sensor.

A corresponding control device can now be provided which, in each case, from the point in time of the signal, which is emitted by the metal sensor and indicates that the casting system is prefilled, takes over the control of the pressing-in operation of the molten metal into the mold.

If it is provided—which is known per se—that the bath level of the molten metal in the furnace, for example, by way of a multichamber furnace, is always kept equally high, it will also be possible to indicate a casting system prefilling curve which is specific to the machine and independent of the mold. Subsequently, the casting plunger advancing and pressure admission system will operate as a function of the mold and can be operated in a known manner.

Other objects, advantages and novel features of the present invention will become apparent from the following detailed description of the invention when considered in conjunction with the accompanying drawings.

BRIEF DESCRIPTION OF THE DRAWINGS

The invention is illustrated in the drawings by means of an embodiment and will be explained in the following drawings, in which.

DETAILED DESCRIPTION OF THE DRAWINGS

Figure 1:
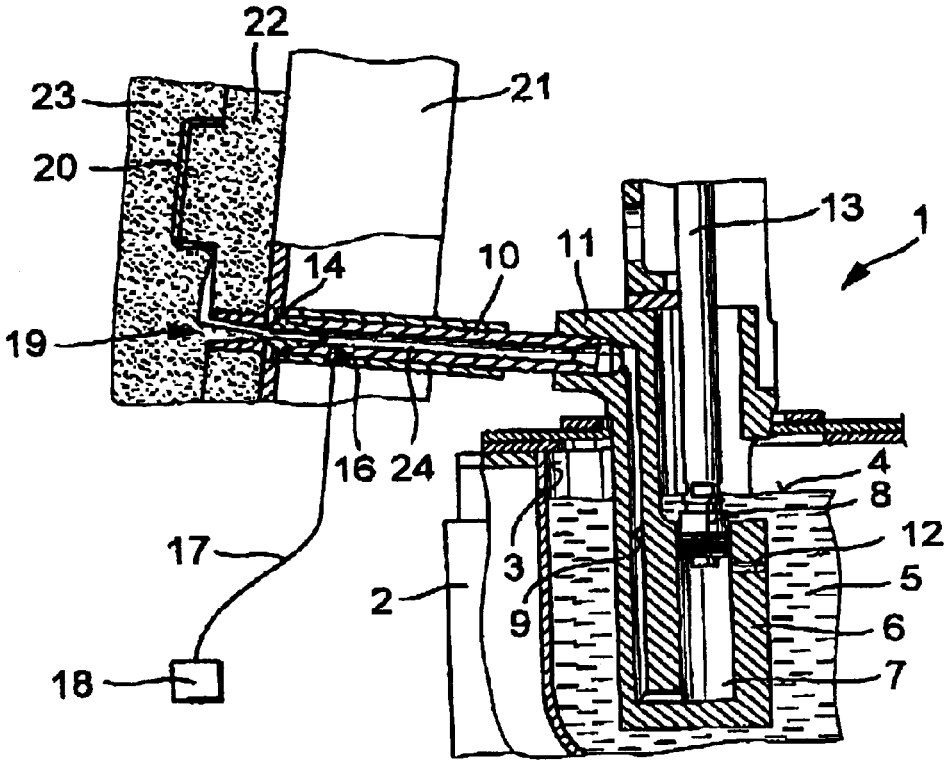
FIG. 1 is a schematic sectional view of the casting system and the mold of a hot-chamber pressure diecasting machine.

FIG. 1 first illustrates that the casting system, which as a whole has the reference number 1, consists of a furnace 2, which is not shown in detail and has a tempered removal chamber 3, in which liquid metal 5 is situated to the level 4. A casting vessel 6 dips into this metal bath formed by the liquid metal 5 and has a cylindrical casting chamber 7 and a casting plunger 8 which moves back and forth therein, as well as an ascending duct 9 connected with the casting chamber 7. The ascending duct 9 leads into a mouthpiece body 10 which is placed in the connection piece 11 of the casting vessel 6 provided at the end of the ascending duct 9, which mouthpiece body 10 is heated just like the connection piece 11, which, however, is not shown in detail.

In addition, the casting chamber 7 is provided with a connection opening 12 to the metal bath 5, which is opened up in the illustrated withdrawn position of the casting plunger 8. The casting plunger 8, in turn, is driven in a controlled manner by way of a plunger rod 13, the casting plunger drive provided for this purpose not being shown.

Figure 2:
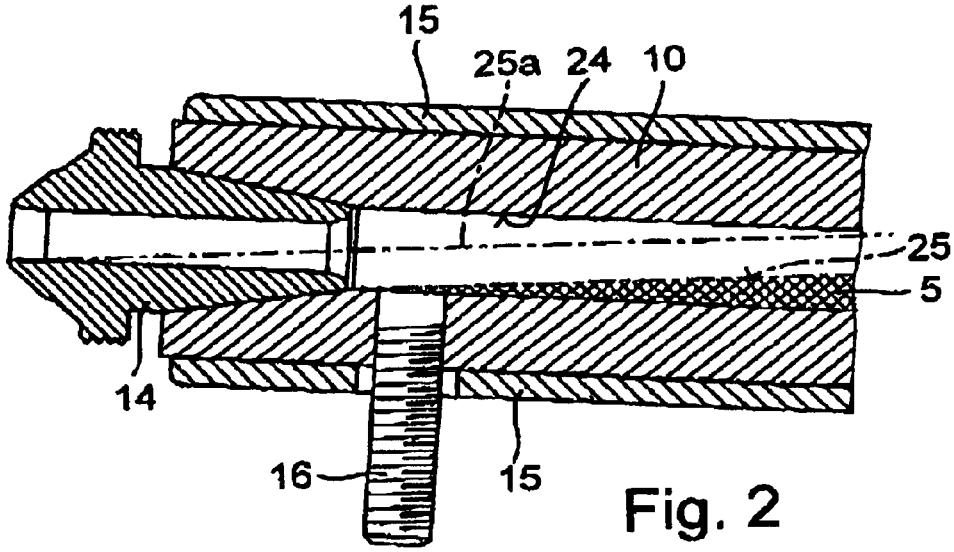
FIG. 2 is an enlarged representation of the end of the mouthpiece area of the casting system equipped with a nozzle tip.

The mouthpiece body 10 is provided with a nozzle tip 14 inserted therein, which is visible in FIG. 2. FIG. 2 also outlines the heater 15 arranged around the mouthpiece body 10. A metal sensor 16 is also shown which is inserted from the underside into the mouthpiece body 10 and is connected by way of a connecting cable 17 with a control device 18 which, in turn, in a manner not shown in detail, is connected with the drive for the casting plunger 8.

Concerning FIG. 1, it should also be noted that the mouthpiece with the nozzle tip 14 is attached to the inflow system 19 for the mold 20, which is constructed of a fixed mold half 22 held on the fixed mold holding plate 21 of the pressure diecasting machine not shown in detail, and of the movable mold half 23 fastened to the not shown movable mold holding plate of the pressure diecasting machine. In a known manner, this mold 20 is equipped with venting ducts and is illustrated in FIG. 1 in the closed condition.

Figure 3:
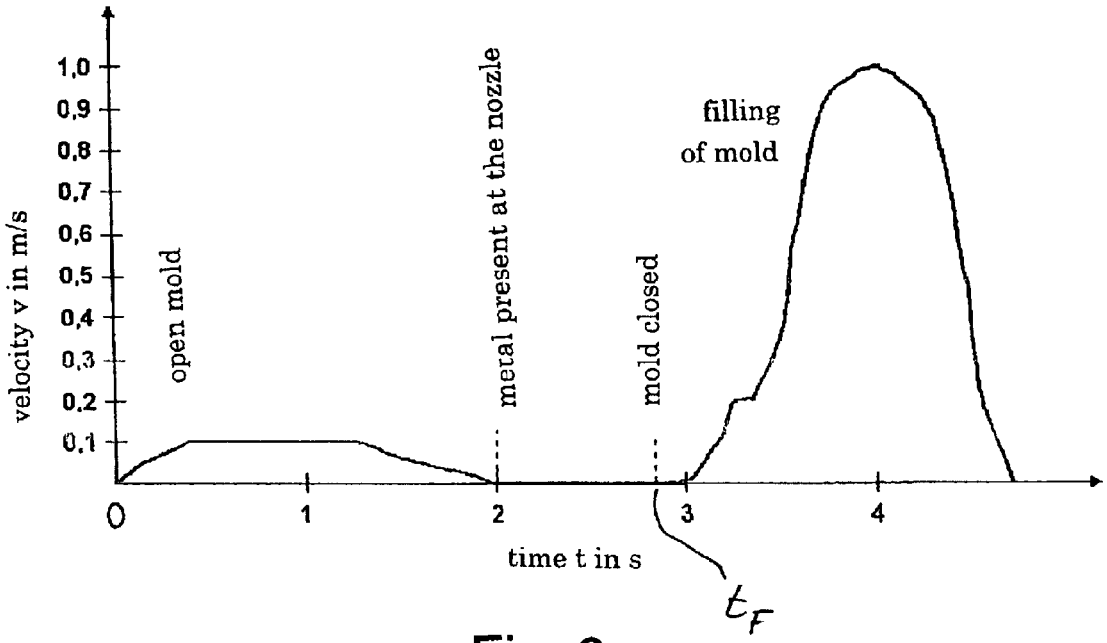
FIG. 3 is a view of the time progression of the moving rate of the casting plunger and of the molten metal delivered by the latter in the casting system according to FIG. 1.

The mold closed according to FIG. 1, according to the new method, is now opened up for removing the workpiece still situated in the mold. This opening of the mold takes place according to FIG. 3 at the zero point in time on the time axis t extending to the right. According to the new method, when the mold is now opened up, the casting plunger 8 is moved downward by its drive from the position illustrated in FIG. 1. In this case, it closes the connection opening 12 to the metal bath 5 and presses the liquid molten material present in the casting chamber 7 and in the adjoining ascending duct 9 to the level 4 through the ascending duct upward into the duct 24 of the mouthpiece 10, which duct 24 rises slightly toward the mold 20. In this case, as outlined in FIG. 2, the liquid molten metal 5 reaches the metal sensor 16 which is inserted from below into the duct 24 of the mouthpiece 10 and floods this sensor 16 at a horizontally extending level 25, so that a signal can be emitted when the molten metal 5 is present at the metal sensor 16 or—after another short time period to be determined empirically—at the nozzle tip 14 to the horizontally extending maximal level 25*a*. This point in time or the point in time at which the molten metal 5 reaches the metal sensor 16 is now utilized, together with "mold closed", as a starting signal for the rapid filling of the mold. In the embodiment of FIG. 3, this takes place at the point in time t after two seconds. The mold itself is closed at the point in time $t_F$ so that subsequently—at the point in time of the expiration of three seconds—, the mold filling operation can start at a high velocity in the manner which has been known.

It is easily demonstrated that the air pushed along by the molten metal in front of the casting plunger 8 at the start of the operation illustrated in FIG. 3 in front of the metal front, which air is still situated in the portion of the ascending duct 9 located above the level 4 and in the duct 24 of the mouthpiece body, can escape without any problems from the still open mold. In this case, the molten metal is filled very slowly and at a low velocity (in the embodiment, approximately 0.1 meters per second) into the casting system which, in this manner, in the embodiment, is prefilled after two seconds. From this prefilled casting system, which is indicated in FIG. 2 by the level 25, after the closing of the mold at the point in time $t_F$, the mold itself can be filled very rapidly and effectively exclusively as a function of the conditions defined by the mold. The air present in the mold and the low air fraction in the nozzle tip 14 (FIG. 2) do not hinder the escaping of this only small amount of air. In this fashion, it is therefore possible that the produced diecast part can be manufactured almost without any trapped air. It is also possible to maintain a shorter cycle period because the prefilling operation for the casting system, which takes place in FIG. 3 during the time from zero to two seconds, takes place during a time period in which the mold has to be open anyhow for the removal of the workpiece.

By means of the new method, diecast parts of a lower weight can also be produced in a reliable process.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of operating a hot-chamber pressure diecasting machine in which a liquid metal is delivered in shots by a casting plunger, which is moved back and forth, from a casting vessel dipping into a metal bath, through an ascending duct of the casting vessel, to a mouthpiece body and a nozzle tip into a mold and is pressurized there, comprising the step of moving the casting plunger, after each shot, while the mold is open, from a withdrawn position, in which the casting plunger opens up an inflow from the metal bath into the casting chamber of the casting vessel, to an advanced position, in which the ascending duct and the mouthpiece body are filled with the liquid metal, followed by the step of closing the mold wherein only then is the liquid metal pressed into the mold.

2. The method according to claim 1, further comprising the steps of detecting an arrival of the liquid metal at the nozzle tip, initiating the mold closing operation, and holding the casting plunger until the mold is closed.

3. A hot-chamber pressure diecasting machine having a duct in a mouthpiece body which rises from an ascending duct to a nozzle tip and having a metal sensor arranged in an area of the nozzle tip, wherein the metal sensor is mounted on an underside of the duct of the mouthpiece body.

4. The hot-chamber pressure diecasting machine according to claim 3, wherein a control device is provided for detecting and analyzing a signal emitted by the metal sensor, which signal is utilized as a starting signal for a start of a pressing-in operation into a mold.

5. The hot-chamber pressure diecasting machine according to claim 4, wherein a casting system prefilling curve is defined which, specifically for the machine, defines a prefilling time and a casting plunger rate.

6. The hot-chamber pressure diecasting machine according to claim 3, wherein the ascending duct is associated with a multichamber furnace which ensures an identical bath level in a removal chamber.

7. A method of operating a hot-chamber pressure diecasting machine, comprising the steps of:

opening a mold;

pre-filling a duct of a mouthpiece body of the diecasting machine with a liquid metal while the mold is open;

closing the mold;

filling the mold with the liquid metal; and further comprising the step of sensing a level of the liquid metal in the duct during the pre-filing step and wherein the steps of closing the mold and filling the mold are performed in response to the step of sensing the level of the liquid metal in the duct.

8. The method according to claim 7 wherein the step of pre-filling the duct has a maximum flow rate of approximately 0.1 m/s for the liquid metal and wherein the step of filling the mold has a maximum flow rate of approximately 1.0 m/s for the liquid metal.

9. A hot-chamber pressure diecasting machine, comprising:

a casting vessel including a casting chamber disposed within a removal chamber of a furnace;

a casting plunger moveably disposed within the casting chamber;

an ascending duct connected with the casting chamber;

a mouthpiece body defining a duct and connected to a connection piece of the ascending duct;

a nozzle lap connected to the mouthpiece body; and a sensor inserted into the mouthpiece body duct from an underside of the mouthpiece body.

10. The hot-chamber pressure diecasting machine according to claim 9 further comprising a control device connected to the sensor wherein the control device controls a movement of the casting plunger.

11. The hot-chamber pressure diecasting machine according to claim 9 wherein the sensor detects a level of a liquid metal within the duct of the mouthpiece body.

12. The hot-chamber pressure diecasting machine according to claim 11 wherein the detected level is less than a full level of the liquid metal within the duct.

13. The hot-chamber pressure diecasting machine according to claim 11 wherein when the sensor detects the level of the liquid metal within the duct a mold filling operation commences in response to the sensor detection.

* * * * *